US007447631B2

(12) United States Patent
Truman et al.

(10) Patent No.: US 7,447,631 B2
(45) Date of Patent: Nov. 4, 2008

(54) AUDIO CODING SYSTEM USING SPECTRAL HOLE FILLING

(75) Inventors: Michael Mead Truman, San Francisco, CA (US); Grant Allen Davidson, Burlingame, CA (US); Matthew Conrad Fellers, San Francisco, CA (US); Mark Stuart Vinton, San Francisco, CA (US); Matthew Aubrey Watson, Sugar Land, TX (US); Charles Quito Robinson, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 843 days.

(21) Appl. No.: 10/174,493

(22) Filed: Jun. 17, 2002

(65) Prior Publication Data

US 2003/0233234 A1 Dec. 18, 2003

(51) Int. Cl.
*G10L 19/00* (2006.01)
*G10L 21/00* (2006.01)

(52) U.S. Cl. ..... 704/230; 704/500

(58) Field of Classification Search ..... 704/200.1, 704/205, 211, 258, 262, 267, 268, 500, 224–225, 704/229–230

See application file for complete search history.

(56) References Cited

U.S. PATENT DOCUMENTS

| | | | |
|---|---|---|---|
| 3,684,838 | A | 8/1972 | Kahn |
| 3,995,115 | A | 11/1976 | Kelly |
| 4,610,022 | A | 9/1986 | Kitayama |
| 4,667,340 | A | 5/1987 | Arjmand et al. |
| 4,757,517 | A | 7/1988 | Yatsuzuka |
| 4,776,014 | A | 10/1988 | Zinser, Jr. |
| 4,790,016 | A | 12/1988 | Mazor et al. |
| 4,885,790 | A | 12/1989 | McAulay et al. |
| 4,914,701 | A | 4/1990 | Zibman |
| 4,935,963 | A | 6/1990 | Jain |
| 5,001,758 | A | 3/1991 | Galand et al. |
| 5,054,072 | A | 10/1991 | McAulay et al. |
| 5,054,075 | A | 10/1991 | Hong et al. |
| 5,109,417 | A | 4/1992 | Fielder et al. |

(Continued)

FOREIGN PATENT DOCUMENTS

| | | |
|---|---|---|
| DE | 19509149 | 9/1996 |

(Continued)

OTHER PUBLICATIONS

Cheung et al, "High Quality 16 KB/S Voice Transmission: The Sub-band Coder Approach," IEEE Conf on Acoust., Speech, Signal Proc., pp. 319-322, 1980.*

(Continued)

*Primary Examiner*—James S Wozniak
(74) *Attorney, Agent, or Firm*—David N. Lathrop; Gallagher & Lathrop

(57) ABSTRACT

Audio coding processes like quantization can cause spectral components of an encoded audio signal to be set to zero, creating spectral holes in the signal. These spectral holes can degrade the perceived quality of audio signals that are reproduced by audio coding systems. An improved decoder avoids or reduces the degradation by filling the spectral holes with synthesized spectral components. An improved encoder may also be used to realize further improvements in the decoder.

24 Claims, 7 Drawing Sheets

U.S. PATENT DOCUMENTS

| | | | | | |
|---|---|---|---|---|---|
| 5,127,054 | A | | 6/1992 | Hong et al. | |
| 5,264,846 | A | * | 11/1993 | Oikawa | 704/229 |
| 5,381,143 | A | * | 1/1995 | Shimoyoshi et al. | 341/51 |
| 5,394,473 | A | | 2/1995 | Davidson | |
| 5,402,124 | A | * | 3/1995 | Todd et al. | 341/131 |
| 5,461,378 | A | * | 10/1995 | Shimoyoshi et al. | 341/51 |
| 5,583,962 | A | | 12/1996 | Davis et al. | |
| 5,623,577 | A | * | 4/1997 | Fielder | 704/200.1 |
| 5,636,324 | A | | 6/1997 | Teh et al. | |
| 5,692,102 | A | * | 11/1997 | Pan | 704/230 |
| 5,758,020 | A | * | 5/1998 | Tsutsui | 704/204 |
| 5,758,315 | A | * | 5/1998 | Mori | 704/229 |
| 5,842,160 | A | * | 11/1998 | Zinser | 704/229 |
| 5,924,064 | A | | 7/1999 | Helf | |
| RE36,478 | E | | 12/1999 | McAulay et al. | |
| 6,014,621 | A | * | 1/2000 | Chen | 704/220 |
| 6,058,362 | A | * | 5/2000 | Malvar | 704/230 |
| 6,092,041 | A | * | 7/2000 | Pan et al. | 704/229 |
| 6,115,689 | A | * | 9/2000 | Malvar | 704/503 |
| 6,138,051 | A | * | 10/2000 | Dieterich | 700/94 |
| 6,222,941 | B1 | * | 4/2001 | Zandi et al. | 382/232 |
| 6,341,165 | B1 | * | 1/2002 | Gbur et al. | 381/23 |
| 6,351,730 | B2 | * | 2/2002 | Chen | 704/229 |
| 6,424,939 | B1 | | 7/2002 | Herre | |
| 6,675,144 | B1 | | 1/2004 | Tucker et al. | |
| 6,708,145 | B1 | * | 3/2004 | Liljeryd et al. | 704/200.1 |
| 2002/0009142 | A1 | * | 1/2002 | Aono et al. | 375/240.11 |
| 2003/0093282 | A1 | * | 5/2003 | Goodwin | 704/500 |
| 2004/0114687 | A1 | * | 6/2004 | Ferris et al. | 375/240.11 |
| 2004/0131203 | A1 | * | 7/2004 | Liljeryd et al. | 381/98 |

FOREIGN PATENT DOCUMENTS

| | | |
|---|---|---|
| EP | 0746116 | 12/1996 |
| WO | 9857436 | 12/1998 |
| WO | WO 0045379 | 8/2000 |
| WO | 0191111 | 11/2001 |
| WO | WO-02/41302 | 5/2002 |

OTHER PUBLICATIONS

Grauel, Christoph, "Sub-Band Coding with Adaptive Bit Allocation," Signal Processing, vol. 2 No 1 Jan. 1980, No. Holland Publishing Co., ISSN 0 165-1684, pp. 23-30.

Makhoul, et al.; "High-Frequency Regeneration in Speech Coding Systems," IEEE Int. Conf. on Acoust., Speech and Sig. Proc., Apr. 1979, pp. 428-431.

Zinser, "An Efficient, Pitch-Aligned High-Frequency Regeneration Technique for RELP Vocoders," IEEE Int. Conf. on Acoust., Speech and Sig. Proc., Mar. 1985, p. 969-972.

Galand, et al., "High-Frequency Regeneration of Base-Band Vocoders by Multi-Pulse Excitation," IEEE Int. Conf. on Acoust., Speech and Sig. Proc., Apr. 1987, pp. 1934-1937.

Laroche, et al., "New Phase-Vocoder Techniques for Pitch-Shifting, Harmonizing and Other Exotic Effects," Proc. IEEE Workshop on Appl. of Sig. Proc. to Audio and Acoust., New Paltz, New York, Oct. 1999, pp. 91-94.

Stott, "DRM—key technical features," EBU Technical Review, Mar. 2001, pp. 1-24.

Bosi, et al., "ISO/IEC MPEG-2 Advanced Audio Coding," J. Audio Eng. Soc., vol. 45, No. 10, Oct. 1997, pp. 789-814.

ATSC Standard: Digital Audio Compression (AC-3), Revision A, Aug. 20, 2001, Sections 1-4, 6, 7.3 and 8.

Atkinson, I. A.; et al., "Time Envelope LP Vocoder: A New Coding Technique at Very Low Bit Rates," 4th E 1995, ISSN 1018-4074, pp. 241-244.

Edler, "Codierung von Audiosignalen mit uberlappender Transformation und Adaptivene Fensterfunktionen," Frequenz, 1989, vol. 43, pp. 252-256.

Herre, et al., "Exploiting Both Time Frequency Structure in a System That Uses an Analysis/Synthesis Filterbank with High Frequency Resolution," 103rd AES Convention, Sep. 1997, preprint 4519.

Herre, et al., "Enhancing the Performance of Perceptual Audio Coders by Using Temporal Noise Shaping (TNS)," 101st AES Convention, Nov. 1996, preprint 4384.

Herre, et al., "Extending the MPEG-4 AAC Codec by Perceptual Noise Substitution," 104th AES Convention, May 1998, preprint 4720.

Rabiner, et al., "Digital Processing of Speech Signals,":Prentice-Hall, 1978, pp. 396-404.

Sugiyama, et. al., "Adaptive Transform Coding With an Adaptive Block Size (ATC-ABS)", IEEE Intl. Con£ on Acoust., Speech, and Sig. Proc., Apr. 1990.

Hans, M., et al., "An MPEG Audio Layered Transcoder" preprints of papers presented at the AES Convention, XX, XX, Sep. 1998, pp. 1-18.

Nakajima, Y., et al. "MPEG Audio Bit Rate Scaling On Coded Data Domain" Acoustics, Speech and Signal Processing, 1998, Proceedings of the 1998 IEEE Int'l. Conf. on Seattle, WA, May 12-15, 1998, New York IEEE pp. 3669-3672.

Ehret, A., et al., "Technical Description of Coding Technologies' Proposal for MPEG-4 v3 General Audio Bandwidth Extension: Spectral Band Replication (SBR)", Coding Technologies AB/GmbH.

* cited by examiner

AUDIO CODING SYSTEM USING SPECTRAL HOLE FILLING

CROSS-REFERENCE TO RELATED APPLICATION

This application is related to U.S. patent application Ser. No. 10/113,858 filed Mar. 28, 2002.

TECHNICAL FIELD

The present invention is related generally to audio coding systems, and is related more specifically to improving the perceived quality of the audio signals obtained from audio coding systems.

BACKGROUND ART

Audio coding systems are used to encode an audio signal into an encoded signal that is suitable for transmission or storage, and then subsequently receive or retrieve the encoded signal and decode it to obtain a version of the original audio signal for playback. Perceptual audio coding systems attempt to encode an audio signal into an encoded signal that has lower information capacity requirements than the original audio signal, and then subsequently decode the encoded signal to provide an output that is perceptually indistinguishable from the original audio signal. One example of a perceptual audio coding system is described in the Advanced Television Standards Committee (ATSC) A52 document (1994), which is referred to as Dolby AC-3. Another example is described in Bosi et al., "ISO/IEC MPEG-2 Advanced Audio Coding." J. AES, vol. 45, no. 10, October 1997, pp. 789-814, which is referred to as Advanced Audio Coding (AAC). These two coding systems, as well as many other perceptual coding systems, apply an analysis filterbank to an audio signal to obtain spectral components that are arranged in groups or frequency bands. The band widths typically vary and are usually commensurate with widths of the so called critical bands of the human auditory system.

Perceptual coding systems can be used to reduce the information capacity requirements of an audio signal while preserving a subjective or perceived measure of audio quality so that an encoded representation of the audio signal can be conveyed through a communication channel using less bandwidth or stored on a recording medium using less space. Information capacity requirements are reduced by quantizing the spectral components. Quantization injects noise into the quantized signal, but perceptual audio coding systems generally use psychoacoustic models in an attempt to control the amplitude of quantization noise so that it is masked or rendered inaudible by spectral components in the signal.

The spectral components within a given band are often quantized to the same quantizing resolution and a psychoacoustic model is used to determine the largest minimum quantizing resolution, or the smallest signal-to-noise ratio (SNR), that is possible without injecting an audible level of quantization noise. This technique works fairly well for narrow bands but does not work as well for wider bands when information capacity requirements constrain the coding system to use a relatively coarse quantizing resolution. The larger-valued spectral components in a wide band are usually quantized to a non-zero value having the desired resolution but smaller-valued spectral components in the band are quantized to zero if they have a magnitude that is less than the minimum quantizing level. The number of spectral components in a band that are quantized to zero generally increases as the band width increases, as the difference between the largest and smallest spectral component values within the band increases, and as the minimum quantizing level increases.

Unfortunately, the existence of many quantized-to-zero (QTZ) spectral components in an encoded signal can degrade the perceived quality of the audio signal even if the resulting quantization noise is kept low enough to be deemed inaudible or psychoacoustically masked by spectral components in the signal. This degradation has at least three causes. The first cause is the fact that the quantization noise may not be inaudible because the level of psychoacoustic masking is less than what is predicted by the psychoacoustic model used to determine the quantizing resolution. A second cause is the fact that the creation of many QTZ spectral components can audibly reduce the energy or power of the decoded audio signal as compared to the energy or power of the original audio signal. A third cause is relevant to coding processes that uses distortion-cancellation filterbanks such as the Quadrature Mirror Filter (QMF) or a particular modified Discrete Cosine Transform (DCT) and modified Inverse Discrete Cosine Transform (IDCT) known as Time-Domain Aliasing Cancellation (TDAC) transforms, which are described in Princen et al., "Subband/Transform Coding Using Filter Bank Designs Based on Time Domain Aliasing Cancellation," *ICASSP* 1987 *Conf. Proc.,* May 1987, pp. 2161-64.

Coding systems that use distortion-cancellation filterbanks such as the QMF or the TDAC transforms use an analysis filterbank in the encoding process that introduces distortion or spurious components into the encoded signal, but use a synthesis filterbank in the decoding process that can, in theory at least, cancel the distortion. In practice, however, the ability of the synthesis filterbank to cancel the distortion can be impaired significantly if the values of one or more spectral components are changed significantly in the encoding process. For this reason, QTZ spectral components may degrade the perceived quality of a decoded audio signal even if the quantization noise is inaudible because changes in spectral component values may impair the ability of the synthesis filterbank to cancel distortion introduced by the analysis filterbank.

Techniques used in known coding systems have provided partial solutions to these problems. Dolby AC-3 and AAC transform coding systems, for example, have some ability to generate an output signal from an encoded signal that retains the signal level of the original audio signal by substituting noise for certain QTZ spectral components in the decoder. In both of these systems, the encoder provides in the encoded signal an indication of power for a frequency band and the decoder uses this indication of power to substitute an appropriate level of noise for the QTZ spectral components in the frequency band. A Dolby AC-3 encoder provides a coarse estimate of the short-term power spectrum that can be used to generate an appropriate level of noise. When all spectral components in a band are set to zero, the decoder fills the band with noise having approximately the same power as that indicated in the coarse estimate of the short-term power spectrum. The AAC coding system uses a technique called Perceptual Noise Substitution (PNS) that explicitly transmits the power for a given band. The decoder uses this information to add noise to match this power. Both systems add noise only in those bands that have no non-zero spectral components.

Unfortunately, these systems do not help preserve power levels in bands that contain a mixture of QTZ and non-zero spectral components. Table 1 shows a hypothetical band of spectral components for an original audio signal, a 3-bit quantized representation of each spectral component that is assembled into an encoded signal, and the corresponding spectral components obtained by a decoder from the encoded signal. The quantized band in the encoded signal has a combination of QTZ and non-zero spectral components.

TABLE 1

| Original Signal Components | Quantized Components | Dequantized Components |
|---|---|---|
| 10101010 | 101 | 10100000 |
| 00000100 | 000 | 00000000 |
| 00000010 | 000 | 00000000 |
| 00000001 | 000 | 00000000 |
| 00011111 | 000 | 00000000 |
| 00010101 | 000 | 00000000 |
| 00001111 | 000 | 00000000 |
| 01010101 | 010 | 01000000 |
| 11110000 | 111 | 11100000 |

The first column of the table shows a set of unsigned binary numbers representing spectral components in the original audio signal that are grouped into a single band. The second column shows a representation of the spectral components quantized to three bits. For this example, the portion of each spectral component below the 3-bit resolution has been removed by truncation. The quantized spectral components are transmitted to the decoder and subsequently dequantized by appending zero bits to restore the original spectral component length. The dequantized spectral components are shown in the third column. Because a majority of the spectral components have been quantized to zero, the band of dequantized spectral components contains less energy than the band of original spectral components and that energy is concentrated in a few non-zero spectral components. This reduction in energy can degrade the perceived quality of the decoded signal as explained above.

DISCLOSURE OF INVENTION

It is an object of the present invention to improve the perceived quality of audio signals obtained from audio coding systems by avoiding or reducing degradation related to zero-valued quantized spectral components.

In one aspect of the present invention, audio information is provided by receiving an input signal and obtaining therefrom a set of subband signals each having one or more spectral components representing spectral content of an audio signal; identifying within the set of subband signals a particular subband signal in which one or more spectral components have a non-zero value and are quantized by a quantizer having a minimum quantizing level that corresponds to a threshold, and in which a plurality of spectral components have a zero value; generating synthesized spectral components that correspond to respective zero-valued spectral components in the particular subband signal and that are scaled according to a scaling envelope less than or equal to the threshold; generating a modified set of subband signals by substituting the synthesized spectral components for corresponding zero-valued spectral components in the particular subband signal; and generating the audio information by applying a synthesis filterbank to the modified set of subband signals.

In another aspect of the present invention, an output signal, preferably an encoded output signal, is provided by generating a set of subband signals each having one or more spectral components representing spectral content of an audio signal by quantizing information that is obtained by applying an analysis filterbank to audio information; identifying within the set of subband signals a particular subband signal in which one or more spectral components have a non-zero value and are quantized by a quantizer having a minimum quantizing level that corresponds to a threshold, and in which a plurality of spectral components have a zero value; deriving scaling control information from the spectral content of the audio signal, wherein the scaling control information controls scaling of synthesized spectral components to be synthesized and substituted for the spectral components having a zero value in a receiver that generates audio information in response to the output signal; and generating the output signal by assembling the scaling control information and information representing the set of subband signals.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

BRIEF DESCRIPTION OF DRAWINGS

FIG. 12 is a graphical schematic illustration of a hypothetical subband signal.

MODES FOR CARRYING OUT THE INVENTION

A. Overview

Figure 1A:
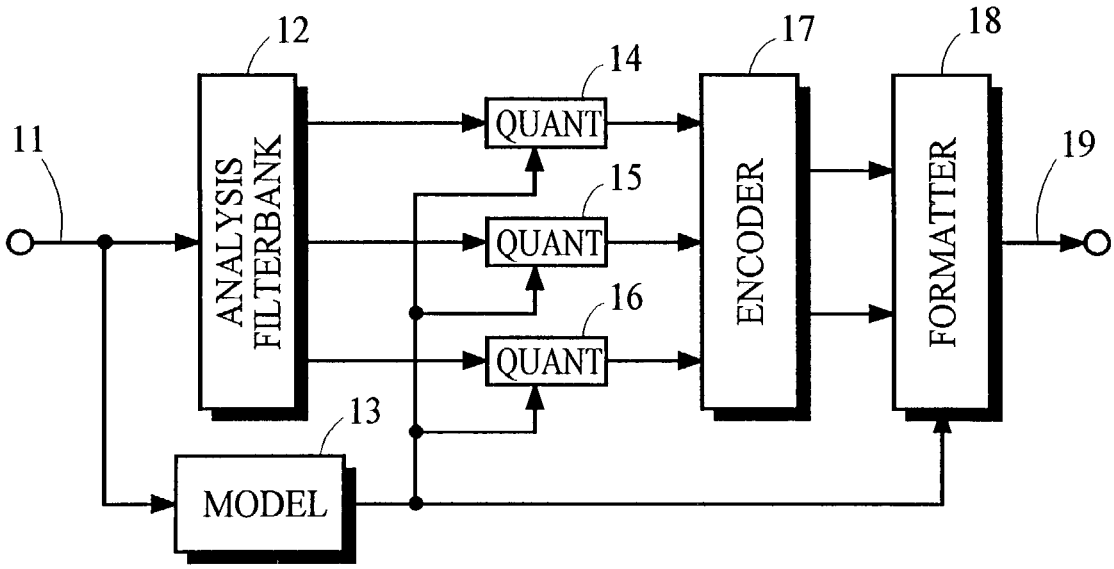
FIG. 1*a* is a schematic block diagram of an audio encoder.
Figure 1B:
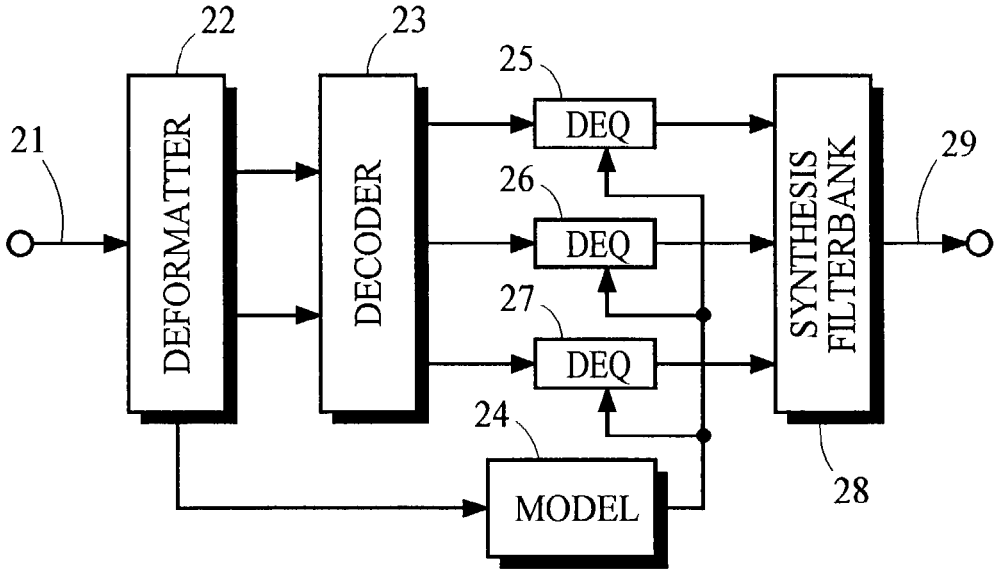
FIG. 1*b* is a schematic block diagram of an audio decoder.

Various aspects of the present invention may be incorporated into a wide variety of signal processing methods and devices including devices like those illustrated in FIGS. 1*a* and 1*b*. Some aspects may be carried out by processing performed in only a decoding method or device. Other aspects require cooperative processing performed in both encoding as well as decoding methods or devices. A description of processes that may be used to carry out these various aspects of the present invention is provided below following an overview of typical devices that may be used to perform these processes.

1. Encoder

FIG. 1*a* illustrates one implementation of a split-band audio encoder in which the analysis filterbank 12 receives from the path 11 audio information representing an audio signal and, in response, provides digital information that represents frequency subbands of the audio signal. The digital information in each of the frequency subbands is quantized by a respective quantizer 14, 15, 16 and passed to the encoder 17. The encoder 17 generates an encoded representation of the quantized information, which is passed to the formatter 18. In the particular implementation shown in the figure, the quantization functions in quantizers 14, 15, 16 are adapted in response to quantizing control information received from the model 13, which generates the quantizing control information in response to the audio information received from the path 11. The formatter 18 assembles the encoded representation of the quantized information and the quantizing control information into an output signal suitable for transmission or storage, and passes the output signal along the path 19.

Figure 2A:
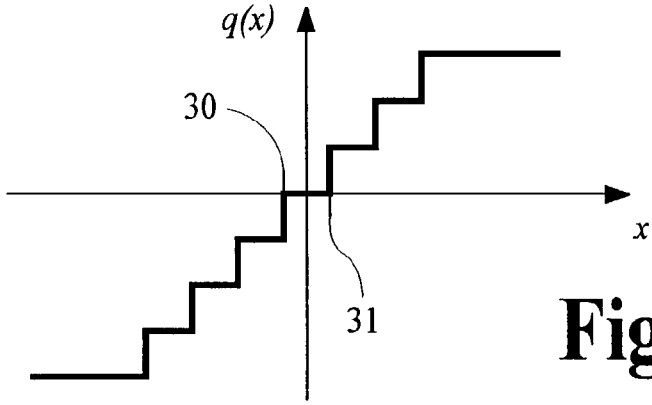
FIGS. 2*a*-2*c* are graphical illustrations of quantization functions.
Figure 2B:
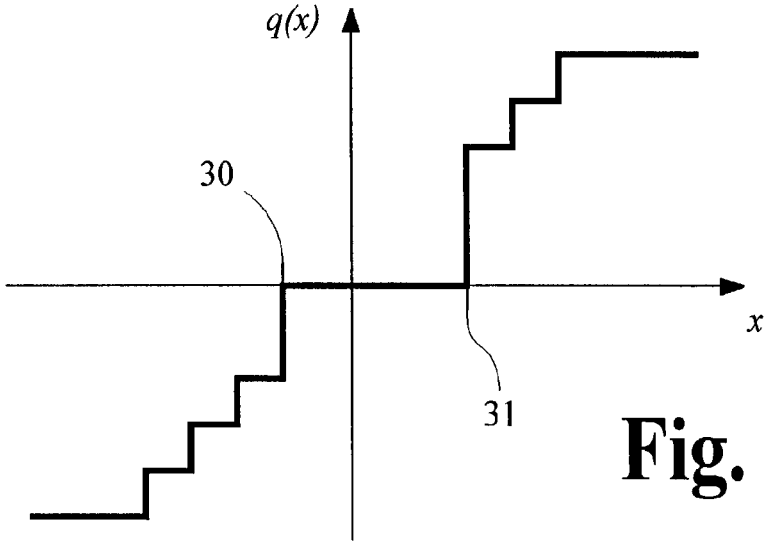
Figure 2C:
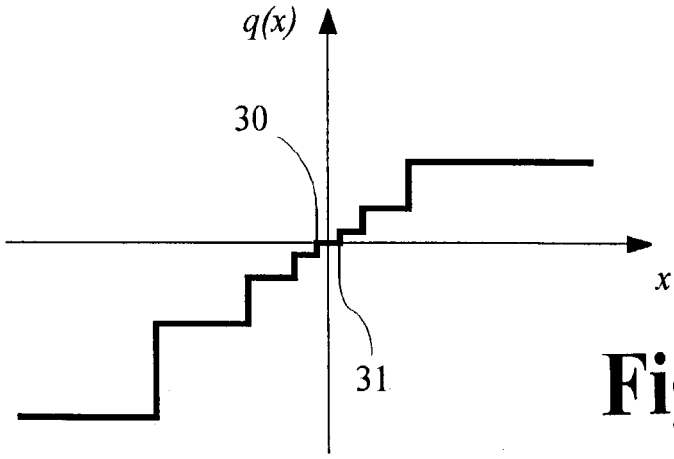

Many audio applications use uniform linear quantization functions q(x) such as the 3-bit mid-tread asymmetric quantization function illustrated in FIG. 2*a;* however, no particular form of quantization is important to the present invention. Examples of two other functions q(x) that may be used are shown in FIGS. 2*b* and 2*c*. In each of these examples, the quantization function q(x) provides an output value equal to zero for any input value x in the interval from the value at point 30 to the value at point 31. In many applications, the two values at points 30, 31 are equal in magnitude and opposite in sign; however, this is not necessary as shown in FIG. 2*b*. For ease of discussion, a value x that is within the interval of input values quantized to zero (QTZ) by a particular quantization function q(x) is referred to as being less than the minimum quantizing level of that quantization function.

In this disclosure, terms like "encoder" and "encoding" are not intended to imply any particular type of information processing. For example, encoding is often used to reduce information capacity requirements; however, these terms in this disclosure do not necessarily refer to this type of processing. The encoder 17 may perform essentially any type of processing that is desired. In one implementation, quantized information is encoded into groups of scaled numbers having a common scaling factor. In the Dolby AC-3 coding system, for example, quantized spectral components are arranged into groups or bands of floating-point numbers where the numbers in each band share a floating-point exponent. In the AAC coding system, entropy coding such as Huffman coding is used. In another implementation, the encoder 17 is eliminated and the quantized information is assembled directly into the output signal. No particular type of encoding is important to the present invention.

The model 13 may perform essentially any type processing that may be desired. One example is a process that applies a psychoacoustic model to audio information to estimate the psychoacoustic masking effects of different spectral components in the audio signal. Many variations are possible. For example, the model 13 may generate the quantizing control information in response to the frequency subband information available at the output of the analysis filterbank 12 instead of, or in addition to, the audio information available at the input of the filterbank. As another example, the model 13 may be eliminated and quantizers 14, 15, 16 use quantization functions that are not adapted. No particular modeling process is important to the present invention.

2. Decoder

FIG. 1*b* illustrates one implementation of a split-band audio decoder in which the deformatter 22 receives from the path 21 an input signal conveying an encoded representation of quantized digital information representing frequency subbands of an audio signal. The deformatter 22 obtains the encoded representation from the input signal and passes it to the decoder 23. The decoder 23 decodes the encoded representation into frequency subbands of quantized information. The quantized digital information in each of the frequency subbands is dequantized by a respective dequantizer 25, 26 , 27 and passed to the synthesis filterbank 28, which generates along the path 29 audio information representing an audio signal. In the particular implementation shown in the figure, the dequantization functions in the dequantizers 25, 26, 27 are adapted in response to quantizing control information received from the model 24, which generates the quantizing control information in response to control information obtained by the deformatter 22 from the input signal.

In this disclosure, terms like "decoder" and "decoding" are not intended to imply any particular type of information processing. The decoder 23 may perform essentially any type of processing that is needed or desired. In one implementation that is inverse to an encoding process described above, quantized information in groups of floating-point numbers having shared exponents are decoded into individual quantized components that do not shared exponents. In another implementation, entropy decoding such as Huffman decoding is used. In another implementation, the decoder 23 is eliminated and the quantized information is obtained directly by the deformatter 22. No particular type of decoding is important to the present invention.

The model 24 may perform essentially any type of processing that may be desired. One example is a process that applies a psychoacoustic model to information obtained from the input signal to estimate the psychoacoustic masking effects of different spectral components in an audio signal. As another example, the model 24 is eliminated and dequantizers 25, 26, 27 may either use quantization functions that are not adapted or they may use quantization functions that are adapted in response to quantizing control information obtained directly from the input signal by the deformatter 22. No particular process is important to the present invention.

3. Filterbanks

The devices illustrated in FIGS. 1*a* and 1*b* show components for three frequency subbands. Many more subbands are used in a typical application but only three are shown for illustrative clarity. No particular number is important in principle to the present invention.

The analysis and synthesis filterbanks may be implemented in essentially any way that is desired including a wide range of digital filter technologies, block transforms and wavelet transforms. In one audio coding system having an encoder and a decoder like those discussed above, the analysis filterbank 12 is implemented by the TDAC modified DCT and the synthesis filterbank 28 is implemented by the TDAC modified IDCT mentioned above; however, no particular implementation is important in principle.

Analysis filterbanks that are implemented by block transforms split a block or interval of an input signal into a set of transform coefficients that represent the spectral content of that interval of signal. A group of one or more adjacent transform coefficients represents the spectral content within a particular frequency subband having a bandwidth commensurate with the number of coefficients in the group.

Analysis filterbanks that are implemented by some type of digital filter such as a polyphase filter, rather than a block transform, split an input signal into a set of subband signals. Each subband signal is a time-based representation of the spectral content of the input signal within a particular frequency subband. Preferably, the subband signal is decimated so that each subband signal has a bandwidth that is commensurate with the number of samples in the subband signal for a unit interval of time.

The following discussion refers more particularly to implementations that use block transforms like the TDAC transform mentioned above. In this discussion, the term "subband signal" refers to groups of one or more adjacent transform coefficients and the term "spectral components" refers to the transform coefficients. Principles of the present invention may be applied to other types of implementations, however, so the term "subband signal" generally may be understood to refer also to a time-based signal representing spectral content of a particular frequency subband of a signal, and the term "spectral components" generally may be understood to refer to samples of a time-based subband signal.

4. Implementation

Figure 17:
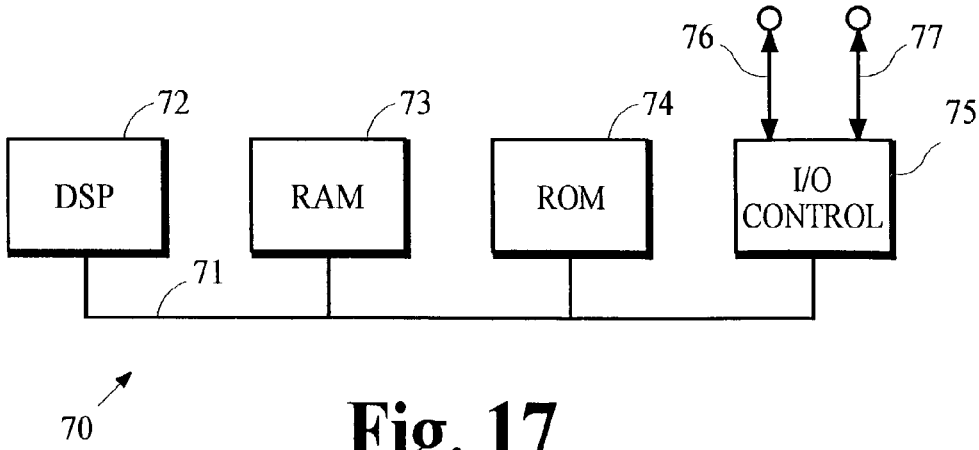
FIG. 17 is a schematic block diagram of an apparatus that may be used to implement various aspects of the present invention in an encoder or a decoder.

Various aspects of the present invention may be implemented in a wide variety of ways including software in a general-purpose computer system or in some other apparatus that includes more specialized components such as digital signal processor (DSP) circuitry coupled to components similar to those found in a general-purpose computer system. FIG. 17 is a block diagram of device 70 that may be used to implement various aspects of the present invention in an audio encoder or audio decoder. DSP 72 provides computing resources. RAM 73 is system random access memory (RAM) used by DSP 72 for signal processing. ROM 74 represents some form of persistent storage such as read only memory (ROM) for storing programs needed to operate device 70 and to carry out various aspects of the present invention. I/O control 75 represents interface circuitry to receive and transmit signals by way of communication channels 76, 77. Analog-to-digital converters and digital-to-analog converters may be included in I/O control 75 as desired to receive and/or transmit analog audio signals. In the embodiment shown, all major system components connect to bus 71, which may represent more than one physical bus; however, a bus architecture is not required to implement the present invention.

In embodiments implemented in a general purpose computer system, additional components may be included for interfacing to devices such as a keyboard or mouse and a display, and for controlling a storage device having a storage medium such as magnetic tape or disk, or an optical medium. The storage medium may be used to record programs of instructions for operating systems, utilities and applications, and may include embodiments of programs that implement various aspects of the present invention.

The functions required to practice various aspects of the present invention can be performed by components that are implemented in a wide variety of ways including discrete logic components, one or more ASICs and/or program-controlled processors. The manner in which these components are implemented is not important to the present invention.

Software implementations of the present invention may be conveyed by a variety machine readable media such as baseband or modulated communication paths throughout the spectrum including from supersonic to ultraviolet frequencies, or storage media including those that convey information using essentially any magnetic or optical recording technology including magnetic tape, magnetic disk, and optical disc. Various aspects can also be implemented in various components of computer system 70 by processing circuitry such as ASICs, general-purpose integrated circuits, microprocessors controlled by programs embodied in various forms of ROM or RAM, and other techniques.

B. Decoder

Various aspects of the present invention may be carried out in a decoder that do not require any special processing or information from an encoder. These aspects are described in this section of the disclosure. Other aspects that do require special processing or information from an encoder are described in the following section.

1. Spectral Holes

Figure 3:
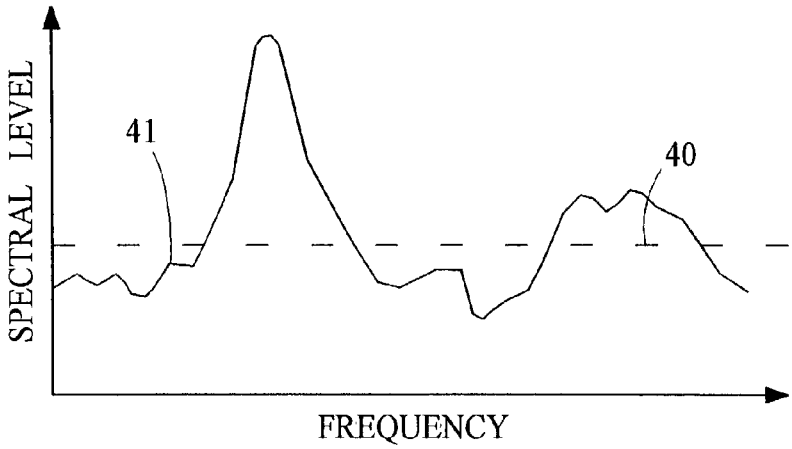
FIG. 3 is a graphical schematic illustration of the spectrum of a hypothetical audio signal.

FIG. 3 is a graphical illustration of the spectrum of an interval of a hypothetical audio signal that is to be encoded by a transform coding system. The spectrum 41 represents an envelope of the magnitude of transform coefficients or spectral components. During the encoding process, all spectral components having a magnitude less than the threshold 40 are quantized to zero. If a quantization function such as the function q(x) shown in FIG. 2*a* is used, the threshold 40 corresponds to the minimum quantizing levels 30, 31. The threshold 40 is shown with a uniform value across the entire frequency range for illustrative convenience. This is not typical in many coding systems. In perceptual audio coding systems that uniformly quantize spectral components within each subband signal, for example, the threshold 40 is uniform within each frequency subband but it varies from subband to subband. In other implementations, the threshold 40 may also vary within a given frequency subband.

Figure 4:
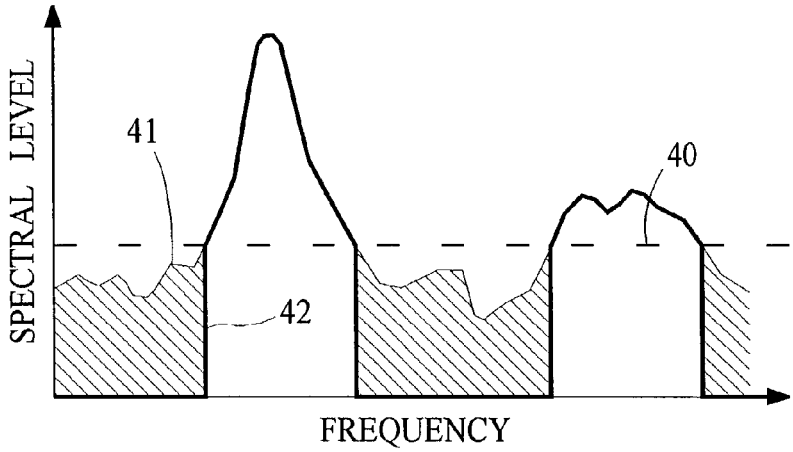
FIG. 4 is a graphical schematic illustration of the spectrum of a hypothetical audio signal with some spectral components set to zero.

FIG. 4 is a graphical illustration of the spectrum of the hypothetical audio signal that is represented by quantized spectral components. The spectrum 42 represents an envelope of the magnitude of spectral components that have been quantized. The spectrum shown in this figure as well as in other figures does not show the effects of quantizing the spectral components having magnitudes greater than or equal to the threshold 40. The difference between the QTZ spectral components in the quantized signal and the corresponding spectral components in the original signal are shown with hatching. These hatched areas represent "spectral holes" in the quantized representation that are to be filled with synthesized spectral components.

In one implementation of the present invention, a decoder receives an input signal that conveys an encoded representation of quantized subband signals such as that shown in FIG. 4. The decoder decodes the encoded representation and identifies those subband signals in which one or more spectral components have non-zero values and a plurality of spectral components have a zero value. Preferably, the frequency extents of all subband signals are either known a priori to the decoder or they are defined by control information in the input signal. The decoder generates synthesized spectral components that correspond to the zero-valued spectral components using a process such as those described below. The synthesized components are scaled according to a scaling envelope that is less than or equal to the threshold 40, and the scaled synthesized spectral components are substituted for the zero-valued spectral components in the subband signal. The decoder does not require any information from the encoder that explicitly indicates the level of the threshold 40 if the minimum quantizing levels 30, 31 of the quantization function q(x) used to quantize the spectral components is known.

2. Scaling

The scaling envelope may be established in a wide variety of ways. A few ways are described below. More than one way may be used. For example, a composite scaling envelope may be derived that is equal to the maximum of all envelopes obtained from multiple ways, or by using different ways to establish upper and/or lower bounds for the scaling envelope. The ways may be adapted or selected in response to characteristics of the encoded signal, and they can be adapted or selected as a function of frequency.

a) Uniform Envelope

Figure 5:
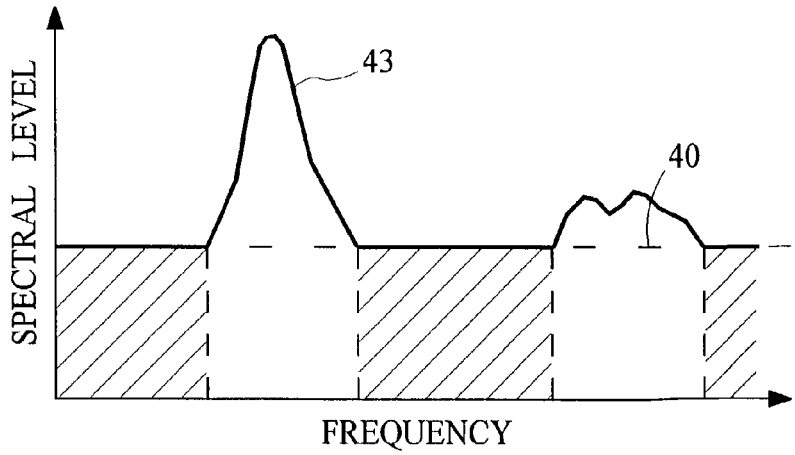
FIG. 5 is a graphical schematic illustration of the spectrum of a hypothetical audio signal with synthesized spectral components substituted for zero-valued spectral components.

One way is suitable for decoders in audio transform coding systems and in systems that use other filterbank implementations. This way establishes a uniform scaling envelope by setting it equal to the threshold 40. An example of such a scaling envelope is shown in FIG. 5, which uses hatched areas to illustrate the spectral holes that are filled with synthesized spectral components. The spectrum 43 represents an envelope of the spectral components of an audio signal with spectral holes filled by synthesized spectral components. The upper bounds of the hatched areas shown in this figure as well as in later figures do not represent the actual levels of the synthesized spectral components themselves but merely represents a scaling envelope for the synthesized components. The synthesized components that are used to fill spectral holes have spectral levels that do not exceed the scaling envelope.

b) Spectral Leakage

A second way for establishing a scaling envelope is well suited for decoders in audio coding systems that use block transforms, but it is based on principles that may be applied to other types of filterbank implementations. This way provides a non-uniform scaling envelope that varies according to spectral leakage characteristics of the prototype filter frequency response in a block transform.

Figure 6:
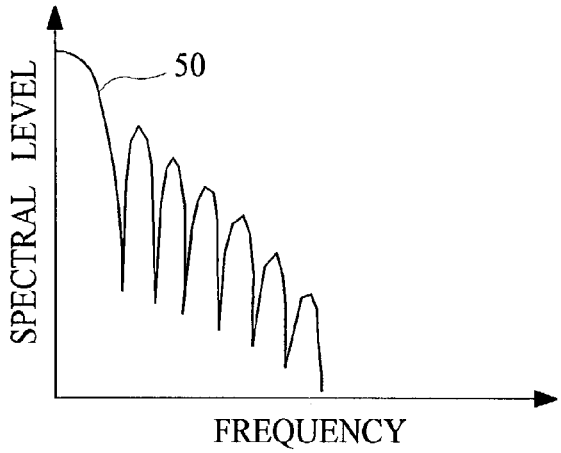
FIG. 6 is a graphical schematic illustration of a hypothetical frequency response for a filter in an analysis filterbank.

The response 50 shown in FIG. 6 is a graphical illustration of a hypothetical frequency response for a transform prototype filter showing spectral leakage between coefficients. The response includes a main lobe, usually referred to as the passband of the prototype filter, and a number of side lobes adjacent to the main lobe that diminish in level for frequencies farther away from the center of the passband. The side lobes represent spectral energy that leaks from the passband into adjacent frequency bands. The rate at which the level of these side lobes decrease is referred to as the rate of roll off of the spectral leakage.

Figure 7:
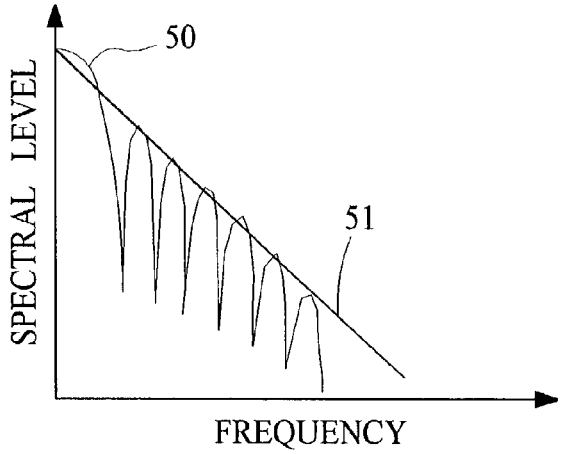
FIG. 7 is a graphical schematic illustration of a scaling envelope that approximates the roll off of spectral leakage shown in FIG. 6.

The spectral leakage characteristics of a filter impose constraints on the spectral isolation between adjacent frequency subbands. If a filter has a large amount of spectral leakage, spectral levels in adjacent subbands cannot differ as much as they can for filters with lower amounts of spectral leakage. The envelope 51 shown in FIG. 7 approximates the roll off of spectral leakage shown in FIG. 6. Synthesized spectral components may be scaled to such an envelope or, alternatively, this envelope may be used as a lower bound for a scaling envelope that is derived by other techniques.

Figure 9:
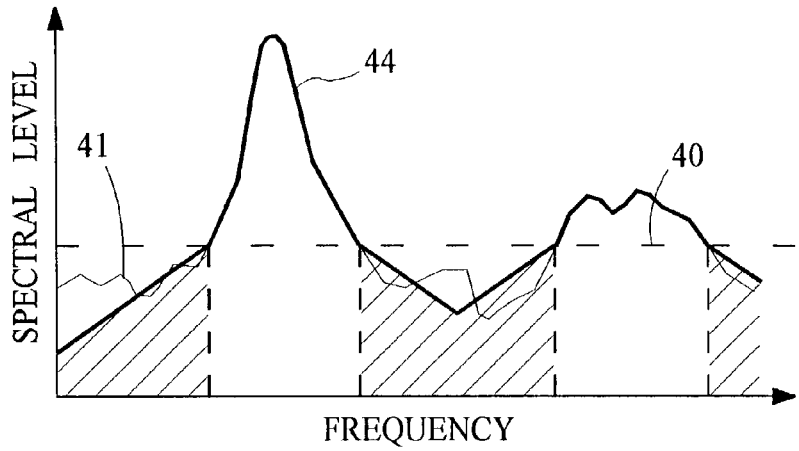
FIG. 9 is a graphical schematic illustration of the spectrum of a hypothetical audio signal with synthesized spectral components weighted by a scaling envelope that approximates the roll off of spectral leakage shown in FIG. 6.

The spectrum 44 in FIG. 9 is a graphical illustration of the spectrum of a hypothetical audio signal with synthesized spectral components that are scaled according to an envelope that approximates spectral leakage roll off The scaling envelope for spectral holes that are bounded on each side by spectral energy is a composite of two individual envelopes, one for each side. The composite is formed by taking the larger of the two individual envelopes.

c) Filter

A third way for establishing a scaling envelope is also well suited for decoders in audio coding systems that use block transforms, but it is also based on principles that may be applied to other types of filterbank implementations. This way provides a non-uniform scaling envelope that is derived from the output of a frequency-domain filter that is applied to transform coefficients in the frequency domain. The filter may be a prediction filter, a low pass filter, or essentially any other type of filter that provides the desired scaling envelope. This way usually requires more computational resources than are required for the two ways described above, but it allows the scaling envelope to vary as a function of frequency.

Figure 8:
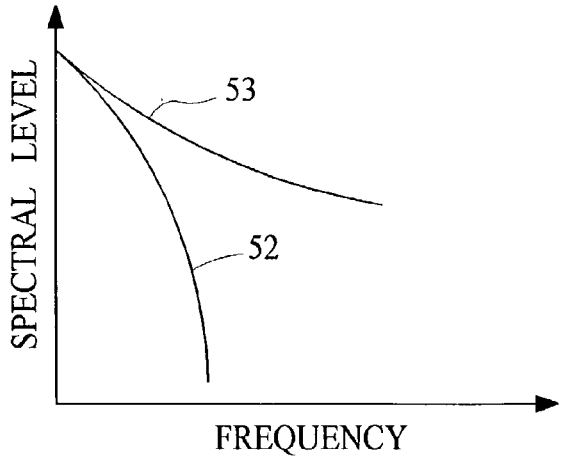
FIG. 8 is a graphical schematic illustration of scaling envelopes derived from the output of an adaptable filter.

FIG. 8 is a graphical illustration of two scaling envelopes derived from the output of an adaptable frequency-domain filter. For example, the scaling envelope 52 could be used for filling spectral holes in signals or portions of signals that are deemed to be more tone like, and the scaling envelope 53 could be used for filling spectral holes in signals or portions of signals that are deemed to be more noise like. Tone and noise properties of a signal can be assessed in a variety of ways. Some of these ways are discussed below. Alternatively, the scaling envelope 52 could be used for filling spectral holes at lower frequencies where audio signals are often more tone like and the scaling envelope 53 could be used for filling spectral holes at higher frequencies where audio signal are often more noise like.

d) Perceptual Masking

A fourth way for establishing a scaling envelope is applicable to decoders in audio coding systems that implement filterbanks with block transforms and other types of filters. This way provides a non-uniform scaling envelope that varies according to estimated psychoacoustic masking effects.

Figure 10:
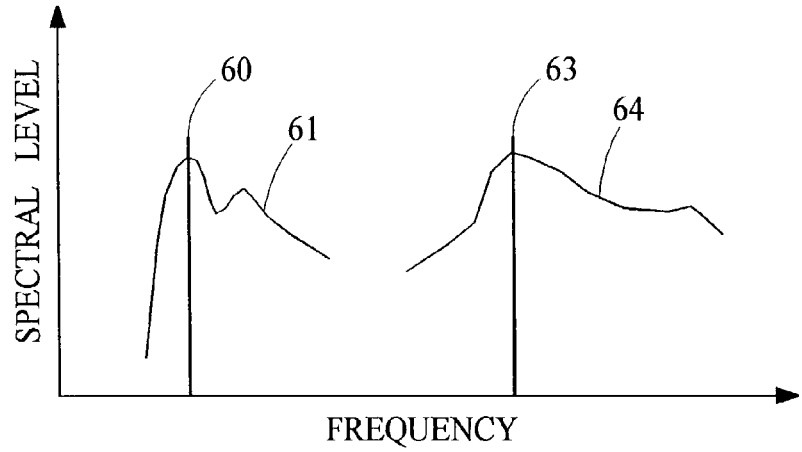
FIG. 10 is a graphical schematic illustration of hypothetical psychoacoustic masking thresholds.

FIG. 10 illustrates two hypothetical psychoacoustic masking thresholds. The threshold 61 represents the psychoacoustic masking effects of a lower-frequency spectral component 60 and the threshold 64 represents the psychoacoustic masking effects of a higher-frequency spectral component 63. Masking thresholds such as these may be used to derive the shape of the scaling envelope.

Figure 11:
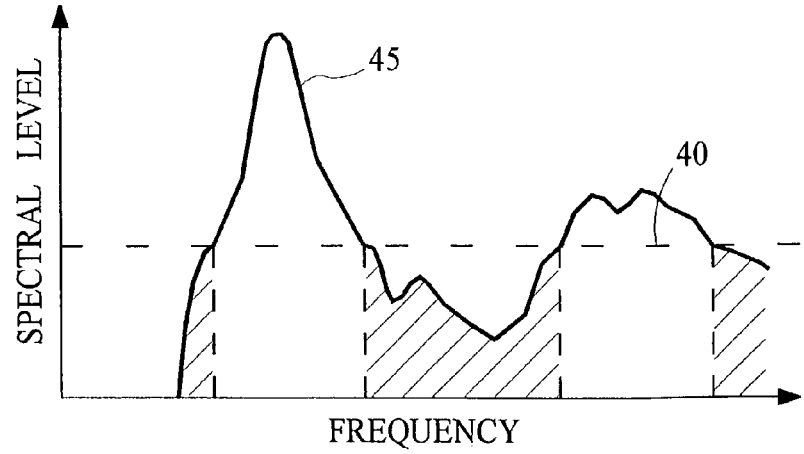
FIG. 11 is a graphical schematic illustration of the spectrum of a hypothetical audio signal with synthesized spectral components weighted by a scaling envelope that approximates psychoacoustic masking thresholds.

The spectrum 45 in FIG. 11 is a graphical illustration of the spectrum of a hypothetical audio signal with substitute synthesized spectral components that are scaled according to envelopes that are based on psychoacoustic masking. In the example shown, the scaling envelope in the lowest-frequency spectral hole is derived from the lower portion of the masking threshold 61. The scaling envelope in the central spectral hole is a composite of the upper portion of the masking threshold 61 and the lower portion of the masking threshold 64. The scaling envelope in the highest-frequency spectral hole is derived from the upper portion of the masking threshold 64.

e) Tonality

A fifth way for establishing a scaling envelope is based on an assessment of the tonality of the entire audio signal or some portion of the signal such as for one or more subband signals. Tonality can be assessed in a number of ways including the calculation of a Spectral Flatness Measure, which is a normalized quotient of the arithmetic mean of signal samples divided by the geometric mean of the signal samples. A value close to one indicates a signal is very noise like, and a value close to zero indicates a signal is very tone like. SFM can be used directly to adapt the scaling envelope. When the SFM is equal to zero, no synthesized components are used to fill a spectral hole. When the SFM is equal to one, the maximum permitted level of synthesized components is used to fill a spectral hole. In general, however, an encoder is able to calculate a better SFM because it has access to the entire original audio signal prior to encoding. It is likely that a decoder will not calculate an accurate SFM because of the presence of QTZ spectral components.

A decoder can also assess tonality by analyzing the arrangement or distribution of the non-zero-valued and the zero-valued spectral components. In one implementation, a signal is deemed to be more tone like rather than noise like if long runs of zero-valued spectral components are distributed between a few large non-zero-valued components because this arrangement implies a structure of spectral peaks.

In yet another implementation, a decoder applies a prediction filter to one or more subband signals and determines the prediction gain. A signal is deemed to be more tone like as the prediction gain increases.

f) Temporal Scaling

FIG. 12 is a graphical illustration of a hypothetical subband signal that is to be encoded. The line 46 represents a temporal envelope of the magnitude of spectral components. This subband signal may be composed of a common spectral component or transform coefficient in a sequence of blocks obtained from an analysis filterbank implemented by a block transform, or it may be a subband signal obtained from another type of analysis filterbank implemented by a digital filter other than a block transform such as a QMF. During the encoding process, all spectral components having a magnitude less than the threshold 40 are quantized to zero. The threshold 40 is shown with a uniform value across the entire time interval for illustrative convenience. This is not typical in many coding systems that use filterbanks implemented by block transforms.

Figure 13:
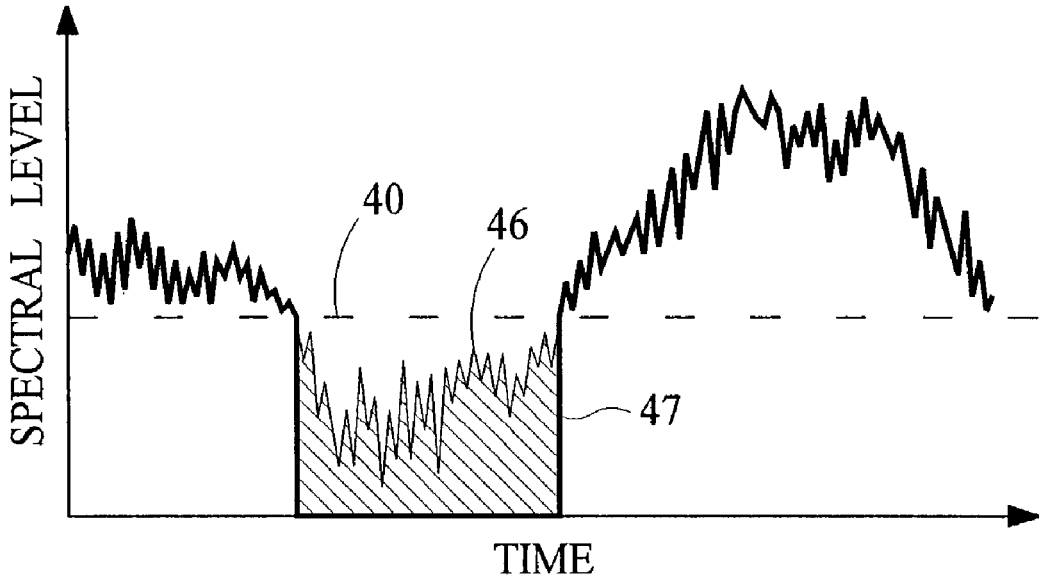
FIG. 13 is a graphical schematic illustration of a hypothetical subband signal with some spectral components set to zero.

FIG. 13 is a graphical illustration of the hypothetical subband signal that is represented by quantized spectral components. The line 47 represents a temporal envelope of the magnitude of spectral components that have been quantized. The line shown in this figure as well as in other figures does not show the effects of quantizing the spectral components having magnitudes greater than or equal to the threshold 40. The difference between the QTZ spectral components in the quantized signal and the corresponding spectral components in the original signal are shown with hatching. The hatched area represents a spectral hole within an interval of time that are is to be filled with synthesized spectral components.

In one implementation of the present invention, a decoder receives an input signal that conveys an encoded representation of quantized subband signals such as that shown in FIG. 13. The decoder decodes the encoded representation and identifies those subband signals in which a plurality of spectral components have a zero value and are preceded and/or followed by spectral components having non-zero values. The decoder generates synthesized spectral components that correspond to the zero-valued spectral components using a process such as those described below. The synthesized components are scaled according to a scaling envelope. Preferably, the scaling envelope accounts for the temporal masking characteristics of the human auditory system.

Figure 14:
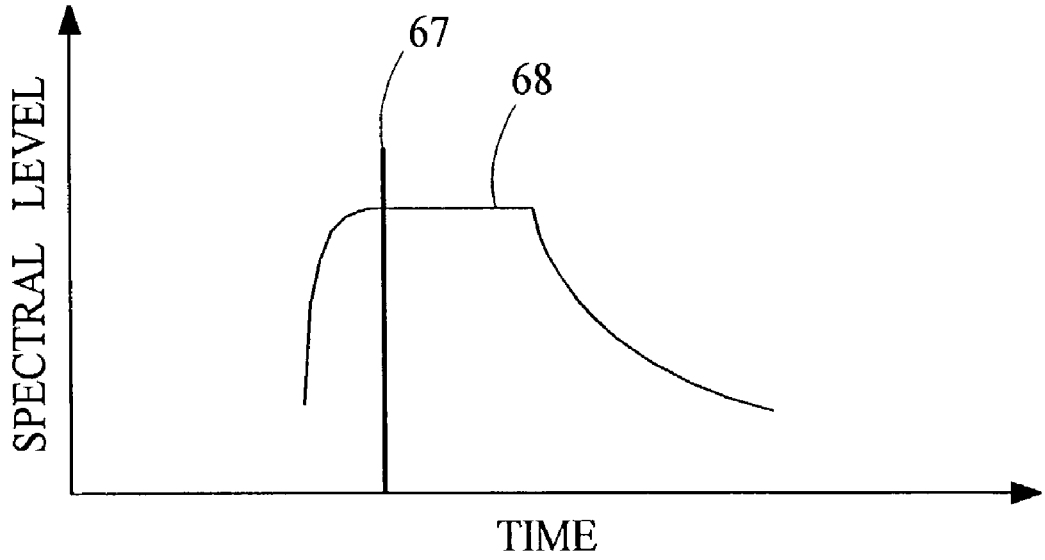
FIG. 14 is a graphical schematic illustration of a hypothetical temporal psychoacoustic masking threshold.

FIG. 14 illustrates a hypothetical temporal psychoacoustic masking threshold. The threshold 68 represents the temporal psychoacoustic masking effects of a spectral component 67. The portion of the threshold to the left of the spectral component 67 represents pre-temporal masking characteristics, or masking that precedes the occurrence of the spectral component. The portion of the threshold to the right of the spectral component 67 represents post-temporal masking characteristics, or masking that follows the occurrence of the spectral component. Post-masking effects generally have a duration that is much longer that the duration of pre-masking effects. A temporal masking threshold such as this may be used to derive a temporal shape of the scaling envelope.

Figure 15:
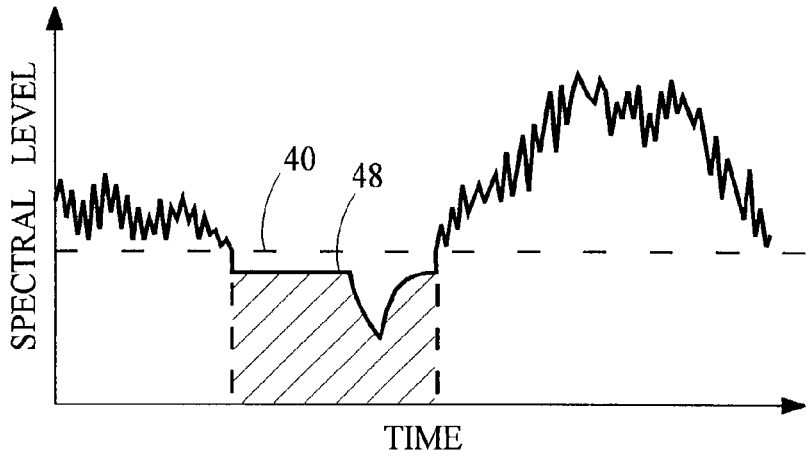
FIG. 15 is a graphical schematic illustration of a hypothetical subband signal with synthesized spectral components weighted by a scaling envelope that approximates temporal psychoacoustic masking thresholds.

The line 48 in FIG. 15 is a graphical illustration of a hypothetical subband signal with substitute synthesized spectral components that are scaled according to envelopes that are based on temporal psychoacoustic masking effects. In the example shown, the scaling envelope is a composite of two individual envelopes. The individual envelope for the lower-frequency part of the spectral hole is derived from the post-masking portion of the threshold 68. The individual envelope for the higher-frequency part of the spectral hole is derived from the pre-masking part of the threshold 68.

3. Generation of Synthesized Components

The synthesized spectral components may be generated in a variety of ways. Two ways are described below. Multiple ways may be used. For example, different ways may selected in response to characteristics of the encoded signal or as a function of frequency.

A first way generates a noise-like signal. Essentially any of a wide variety of ways for generating pseudo-noise signals may be used.

A second way uses a technique called spectral translation or spectral replication that copies spectral components from one or more frequency subbands. Lower-frequency spectral components are usually copied to fill spectral holes at higher frequencies because higher frequency components are often related in some manner to lower frequency components. In principle, however, spectral components may be copied to higher or lower frequencies.

Figure 16:
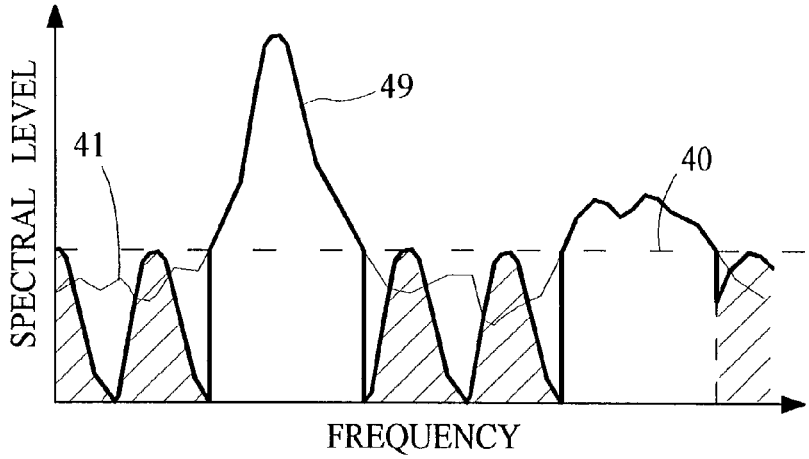
FIG. 16 is a graphical schematic illustration of the spectrum of a hypothetical audio signal with synthesized spectral components generated by spectral replication.

The spectrum 49 in FIG. 16 is a graphical illustration of the spectrum of a hypothetical audio signal with synthesized spectral components generated by spectral replication. A portion of the spectral peak is replicated down and up in frequency multiple times to fill the spectral holes at the low and middle frequencies, respectively. A portion of the spectral components near the high end of the spectrum are replicated up in frequency to fill the spectral hole at the high end of the spectrum. In the example shown, the replicated components are scaled by a uniform scaling envelope; however, essentially any form of scaling envelope may be used.

C. Encoder

The aspects of the present invention that are described above can be carried out in a decoder without requiring any modification to existing encoders. These aspects can be enhanced if the encoder is modified to provide additional control information that otherwise would not be available to the decoder. The additional control information can be used to adapt the way in which synthesized spectral components are generated and scaled in the decoder.

1. Control Information

An encoder can provide a variety of scaling control information, which a decoder can use to adapt the scaling envelope for synthesized spectral components. Each of the examples discussed below can be provided for an entire signal and/or for frequency subbands of the signal.

If a subband contains spectral components that are significantly below the minimum quantizing level, the encoder can provide information to the decoder that indicates this condition. The information may be a type of index that a decoder can use to select from two or more scaling levels, or the information may convey some measure of spectral level such as average or root-mean-square (RMS) power. The decoder can adapt the scaling envelope in response to this information.

As explained above, a decoder can adapt the scaling envelope in response to psychoacoustic masking effects estimated from the encoded signal itself, however, it is possible for the encoder to provide a better estimate of these masking effects when the encoder has access to features of the signal that are lost by an encoding process. This can be done by having the model 13 provide psychoacoustic information to the formatter 18 that is otherwise not available from the encoded signal. Using this type of information, the decoder is able to adapt the scaling envelope to shape the synthesized spectral components according to one or more psychoacoustic criteria.

The scaling envelope can also be adapted in response to some assessment of the noise-like or tone-like qualities of a signal or subband signal. This assessment can be done in several ways by either the encoder or the decoder; however, an encoder is usually able to make a better assessment. The results of this assessment can be assembled with the encoded signal. One assessment is the SFM described above.

An indication of SFM can also be used by a decoder to select which process to use for generating synthesized spectral components. If the SFM is close to one, the noise-generation technique can be used. If the SFM is close to zero, the spectral replication technique can be used.

An encoder can provide some indication of power for the non-zero and the QTZ spectral components such as a ratio of these two powers. The decoder can calculate the power of the non-zero spectral components and then use this ratio or other indication to adapt the scaling envelope appropriately.

2. Zero Spectral Coefficients

The previous discussion has sometimes referred to zero-valued spectral components as QTZ (quantized-to-zero) components because quantization is a common source of zero-valued components in an encoded signal. This is not essential. The value of spectral components in an encoded signal may be set to zero by essentially any process. For example, an encoder may identify the largest one or two spectral components in each subband signal above a particular frequency and set all other spectral components in those subband signals to zero. Alternatively, an encoder may set to zero all spectral components in certain subbands that are less than some threshold. A decoder that incorporates various aspects of the present invention as described above is able to fill spectral holes regardless of the process that is responsible for creating them.

The invention claimed is:

1. A method for generating audio information, wherein the method comprises:

receiving an input signal and obtaining therefrom a set of subband signals each having one or more spectral components representing spectral content of an audio signal;

identifying within the set of subband signals a particular subband signal in which one or more spectral components have a non-zero value and in which one or more of the spectral components have a zero value;

deriving a scaling envelope from the one or more spectral components that have non-zero values, wherein the scaling envelope varies at a rate substantially equal to a rate of roll off of spectral leakage between adjacent subband signals of a synthesis filterbank;

generating one or more synthesized spectral components that correspond to zero-valued spectral components in the particular subband signal and that are scaled according to the scaling envelope;

generating a modified set of subband signals by substituting the synthesized spectral components for corresponding zero-valued spectral components in the particular subband signal; and generating the audio information by applying the synthesis filterbank to the modified set of subband signals.

2. The method of claim 1 wherein the synthesis filterbank is implemented by a block transform and the method comprises:

applying a frequency-domain filter to one or more spectral components in the set of subband signals; and deriving the scaling envelope from an output of the frequency-domain filter.

3. The method of claim 2 that comprises varying a response of the frequency-domain filter us a function of frequency.

4. The method of claim 1 that comprises:

obtaining a measure of tonality of the audio signal represented by the set of subband signals; and adapting the scaling envelope in response to the measure of tonality.

5. The method of claim 1 that comprises:

obtaining a sequence of sets of subband signals from the input signal;

identifying a common subband signal in the sequence of sets of subband signals where one or more spectral components have a zero value;

scaling the one or more synthesized spectral components that correspond to the one or more zero-valued spectral components according to the scaling envelope, wherein the scaling envelope extends from set to set in the sequence;

generating a sequence of modified sets of subband signals by substituting the synthesized spectral components for the corresponding zero-valued spectral components in the sets; and generating the audio information by applying the synthesis filterbank to the sequence of modified sets of subband signals.

6. The method of claim 1 wherein the synthesized spectral components are generated by spectral translation of other spectral components in the set of subband signals.

7. The method of claim 1 wherein the scaling envelope varies according to human auditory temporal masking characteristics.

8. The method according to claim 1 that obtains scaling control information from the input signal, wherein values of the synthesized components are scaled also in response to the scaling control information.

9. An apparatus for generating audio information, wherein the apparatus comprises:

a deformatter that receives an input signal and obtains therefrom a sec of subband signals each having one or more spectral components representing spectral content of an audio signal;

a decoder coupled to the deformatter that identifies within the set of subband signals a particular subband signal in which one or more spectral components have a non-zero value and in which one or more of the spectral components have a zero value, that derives a scaling envelope from the one or more spectral components that have non-zero values, wherein the scaling envelope varies at a rate substantially equal to a rate of roll off of spectral leakage between adjacent subband signals of a synthesis filterbank, that generates one or more synthesized spectral components that correspond to zero-valued spectral components in the particular subband signal and are scaled according to the scaling envelope, and that generates a modified set of subband signals by substituting the synthesized spectral components for corresponding zero-valued spectral components in the particular subband signal; and the synthesis filterbank coupled to the decoder that generates the audio information in response to the modified set of subband signals.

10. The apparatus of claim 9 wherein the synthesis filterbank is implemented by a block transform and the decoder:

applies a frequency-domain filter to one or more spectral components in the set of subband signals; and derives the scaling envelope from an output of the frequency-domain filter.

11. The apparatus of claim 10 wherein the decoder varies a response of the frequency-domain filter as a function of frequency.

12. The apparatus of claim 9 wherein the decoder:

obtains a measure of tonality of the audio signal represented by the set of subband signals; and adapts the scaling envelope in response to the measure of tonality.

13. The apparatus of claim 9 wherein:

the deformatter obtains a sequence of sets of subband signals from the input signal;

the decoder identifies a common subband signal in the sequence of sets of subband signals where one or more spectral components have a zero value, scales the one or more synthesized spectral components that correspond to the one or more zero-valued spectral components according to the scaling envelope, wherein the scaling envelope extends from set to set in the sequence; and generates a sequence of modified sets of subband signals by substituting the synthesized spectral components for the corresponding zero-valued spectral components in the sets; and the synthesis filterbank generates the audio information in response to the sequence of modified sets of subband signals.

14. The apparatus of claim 9 wherein the synthesized spectral components are generated by spectral translation of other spectral components in the set of subband signals.

15. The apparatus of claim 9 wherein the scaling envelope varies according to human auditory temporal masking characteristics.

16. The apparatus according to claim 9 that obtains scaling control information from the input signal, wherein values of the synthesized components are scaled also in response to the scaling control information.

17. A computer-readable storage medium recording a program of instructions that is readable by a processor for executing the program of instructions to perform a method for generating audio information, wherein the method comprises:

receiving an input signal and obtaining therefrom a set of subband signals each having one or more spectral components representing spectral content of an audio signal;

identifying within the set of subband signals a particular subband signal in which one or more spectral components have a non-zero value and in which one or more of the spectral components have a zero value;

deriving a scaling envelope from the one or more spectral components that have non-zero values, wherein the scaling envelope varies at a rate substantially equal to a rate roll off of spectral leakage between adjacent subband signals of a synthesis filterbank;

generating one or more synthesized spectral components that correspond to zero-valued spectral components in the particular subband signal and that are scaled according to the scaling envelope;

generating a modified set of subband signals by substituting the synthesized spectral components for corresponding zero-valued spectral components in the particular subband signal; and generating the audio information by applying the synthesis filterbank to the modified set of subband signals.

18. The medium of claim 17 wherein the synthesis filterbank is implemented by a block transform and the method comprises:

applying a frequency-domain filter to one or more spectral components in the set of subband signals; and deriving the scaling envelope from an output of the frequency-domain filter.

19. The medium of claim 18 wherein the method comprises varying a response of the frequency-domain filter as a function of frequency.

20. The medium of claim 17 wherein the method comprises:

obtaining a measure of tonality of the audio signal represented by the set of subband signals; and adapting the scaling envelope in response to the measure of tonality.

21. The medium of claim 17 wherein the method comprises:

obtaining a sequence of sets of subband signals from the input signal;

identifying a common subband signal in the sequence of sets of subband signals where one or more spectral components have a zero value;

scaling the one or more synthesized spectral components that correspond to the one or more zero-valued spectral components according to the scaling envelope, wherein the scaling envelope extends from set to set in the sequence;

generating a sequence of modified sets of subband signals by substituting the synthesized spectral components for the corresponding zero-valued spectral components in the sets; and generating the audio information by applying the synthesis filterbank to the sequence of modified sets of subband signals.

22. The medium of claim 17 wherein the synthesized spectral components are generated by spectral translation of other spectral components in the set of subband signals.

23. The medium of claim 17 wherein the scaling envelope varies according to human auditory temporal masking characteristics.

24. The medium according to claim 17 wherein the method obtains scaling control information from the input signal, wherein values of the synthesized components are scaled also in response to the scaling control information.

* * * * *